US011903436B2

(12) United States Patent
Fusillo

(10) Patent No.: US 11,903,436 B2
(45) Date of Patent: Feb. 20, 2024

(54) ELASTIC BAND FOR CLOTHING

(71) Applicant: Ricky Fusillo, Tequesta, FL (US)

(72) Inventor: Ricky Fusillo, Tequesta, FL (US)

( * ) Notice: Subject to any disclaimer, the term of this patent is extended or adjusted under 35 U.S.C. 154(b) by 25 days.

(21) Appl. No.: 17/519,280

(22) Filed: Nov. 4, 2021

(65) Prior Publication Data

US 2022/0132962 A1 May 5, 2022

Related U.S. Application Data

(60) Provisional application No. 63/109,389, filed on Nov. 4, 2020.

(51) Int. Cl.
*A41F 9/02* (2006.01)
*A41F 11/02* (2006.01)

(52) U.S. Cl.
CPC ..... *A41F 9/025* (2013.01); *A41F 11/02* (2013.01)

(58) Field of Classification Search
CPC ..... A41F 9/025; A41F 11/02
See application file for complete search history.

(56) References Cited

U.S. PATENT DOCUMENTS 272,695 A * 2/1883 Horner ..... A41F 9/025 5/498
463,985 A * 11/1891 Preese ..... A41F 9/025 24/301
863,716 A * 8/1907 Hunter ..... A41F 9/02 24/301
934,290 A * 9/1909 Wander ..... A41F 9/025 2/319
939,058 A * 11/1909 Morris ..... A41F 9/02 2/112
1,105,282 A * 7/1914 Leibel ..... A41F 9/025 2/237
1,401,227 A * 12/1921 Wyeth ..... A41F 15/02 24/301
1,412,033 A * 4/1922 Able ..... A41F 11/02 2/323
1,421,514 A * 7/1922 McFarland ..... A41F 9/025 24/702
1,469,682 A * 10/1923 North ..... A41F 9/025 24/301
1,607,156 A * 11/1926 Godshaw ..... A41F 9/025 2/309
1,698,071 A * 1/1929 Roth ..... A41F 11/02 2/335
1,782,057 A * 11/1930 Bollinger ..... A41F 19/005 24/301
2,070,016 A * 2/1937 Lipton ..... A41F 11/04 2/335
2,143,561 A * 1/1939 Koppelman ..... A41F 9/025 2/237

(Continued)

*Primary Examiner* — Khaled Annis
(74) *Attorney, Agent, or Firm* — McHale & Slavin, P.A.

(57) ABSTRACT

An elastic band for use with articles of clothing. The elastic clothing band is configured to attach or secure to two different portions of an article of clothing, such as shorts or pants, and provide a mechanism for holding up the article of clothing to a user's body. The elastic clothing band may comprise a first end comprising a first article of clothing securing member, a second opposing end comprising a second article of clothing securing member, and a main body separating the first end and the second end.

15 Claims, 15 Drawing Sheets

(56) References Cited

U.S. PATENT DOCUMENTS 2,233,136 A * 2/1941 Larson ..... A41F 9/025 2/237
2,298,381 A * 10/1942 Horwitz ..... A41F 9/025 D2/742
2,562,386 A * 7/1951 McCormick ..... A41F 9/025 D11/231
2,837,748 A * 6/1958 Manning ..... A41F 9/00 2/337
2,911,653 A * 11/1959 O'Donnell ..... A41F 9/002 2/339
3,001,204 A * 9/1961 Harrison ..... A41F 9/025 2/309
3,341,862 A * 9/1967 Wiesner ..... A41F 9/025 2/221
4,580,298 A * 4/1986 Tuisl ..... A41F 9/025 2/338
4,800,594 A * 1/1989 Young ..... A41D 27/08 2/919
5,313,669 A * 5/1994 Rasdell ..... A41F 17/00 2/112
5,566,397 A * 10/1996 Scott ..... A41F 9/025 24/301
5,898,947 A * 5/1999 Page ..... A41F 9/025 2/221
6,085,356 A * 7/2000 Redmond, Sr. ..... A41F 9/02 2/338
6,163,937 A * 12/2000 McKinnis ..... A41F 15/02 2/323
6,339,848 B1 * 1/2002 Mayhood ..... A41F 9/002 2/338
6,389,605 B2 * 5/2002 Srivastava ..... A41F 1/00 2/311
6,880,175 B2 * 4/2005 Tajima ..... A41F 9/025 2/221
7,895,674 B2 * 3/2011 Miller ..... A41F 9/002 2/338
7,937,776 B1 * 5/2011 Anderson ..... A41F 9/002 2/338
9,101,789 B2 * 8/2015 Schierenbeck .... A62B 35/0031
9,371,120 B2 * 6/2016 Williams, Jr. ..... B63C 9/13
11,484,069 B2 * 11/2022 Edmark ..... A41C 3/02
2002/0092138 A1 * 7/2002 Spiller ..... A44B 18/00 24/306
2009/0007316 A1 * 1/2009 Escudero Munoz ..... A41F 1/00 2/311
2010/0162468 A1 * 7/2010 Hanson ..... A41F 9/002 2/338
2010/0235967 A1 * 9/2010 Janakus ..... A41F 9/025 2/311
2011/0179554 A1 * 7/2011 Bumsted ..... A41F 9/025 2/311
2012/0159694 A1 * 6/2012 Ploughman ..... A41F 9/002 2/338
2012/0246791 A1 * 10/2012 Weisman ..... A41D 7/00 2/67
2014/0026291 A1 * 1/2014 Webster ..... A41B 3/00 2/244
2014/0115755 A1 * 5/2014 Mahar ..... A41F 9/025 2/336
2014/0208485 A1 * 7/2014 Kjar ..... A41D 1/21 2/312
2015/0272249 A1 * 10/2015 Glenn ..... A41F 9/002 2/338
2017/0020217 A1 * 1/2017 Manning ..... A41F 9/025
2017/0188665 A1 * 7/2017 Greenham ..... A44B 11/22
2018/0055119 A1 * 3/2018 Groff ..... A41F 9/02
2018/0116319 A1 * 5/2018 Lindsay ..... A41F 9/002
2018/0116320 A1 * 5/2018 Kjar ..... A41D 1/21
2020/0022426 A1 * 1/2020 Kasabo ..... A41D 27/20
2020/0253309 A1 * 8/2020 Wexelbaum ..... A41F 9/007
2022/0071328 A1 * 3/2022 Wexelbaum ..... A45F 5/021
2022/0132962 A1 * 5/2022 Fusillo ..... A41F 9/025 2/237
2022/0346479 A1 * 11/2022 Wexelbaum ..... A41F 9/025

* cited by examiner

ELASTIC BAND FOR CLOTHING

CROSS REFERENCE TO RELATED APPLICATIONS

In accordance with 37 C.F.R. § 1.76, a claim of priority is included in an Application Data Sheet filed concurrently herewith. Accordingly, the present invention claims priority to U.S. Provisional Patent Application No. 63/109,389, entitled "ELASTIC BAND FOR CLOTHING", filed Nov. 4, 2020. The contents of the above referenced applications are incorporated herein by reference in their entirety.

FIELD OF THE INVENTION

The present invention is related to articles of clothing; and more particularly to a device for securing or holding up an article of clothing, such as shorts or pants, to a user's body.

BACKGROUND OF THE INVENTION

Use of belts in the clothing industry is well known. Typical belts are flexible bands or straps of material, typically leather, that extend around a user's waist in order to secure or hold up an article of clothing, such as a pair of shorts or pants. While very functional, such belts have their drawbacks. For example, because the belt is designed to entirely encircle the user's waste, quickly and easily removing and/or putting on may be difficult. For those individuals that have difficulty with the use of their hands and arms, putting on or removing belts can be cumbersome. Even for those individuals that do not suffer these issues, there are times when removing his/her belt requires ease and speed, such as when moving through an airport security check. In addition, because the belt is placed around the user's waist, at certain positions, particularly when the user is sitting down, the belt can be pushed up against a portion of the user's body, such as his/her stomach. In this situation, the user may feel uncomfortable, and in some situations, may even experience pain.

SUMMARY OF THE INVENTION

The present invention relates to an elastic clothing band for securing or holding up an article of clothing, such as shorts or pants, to a user's body. The elastic nature of the elastic clothing band allows the elastic clothing band to function as a device that holds up a person's article of clothing, such as a shorts or pants, without the need of wearing a belt or a pair of suspenders. The ability to stretch and return to its original shape allows the elastic clothing band to cinch up the shorts' or pants' waistline. In use, the user applies securing members to two different portions of the article of clothing, i.e. two different belt loops of shorts or pants. Once secured to the first belt loop, the user stretches the elastic clothing band to secure or attach to a second belt loop. The elastic nature of the elastic clothing band also allows the band to conform the wear's body as the body moves and/or sits down, thus preventing any associated pain, discomfort, or pressure to the body. Once hooked, the elastic clothing band may contract back towards its original shape and/or size. The contraction of the elastic clothing band causes cinching of the waistband of the article of clothing.

Accordingly, it is an objective of the invention to provide a device for securing or holding up an article of clothing, such as shorts or pants, to a user's body.

It is a further objective of the invention to provide a device for securing or holding up an article of clothing, such as shorts or pants, to a user's body which can be easily put on and taken off.

It is yet another objective of the invention to provide a device for securing or holding up an article of clothing, such as shorts or pants, to a user's body which uses an elastic material.

It is a still further objective of the invention to provide a device for securing or holding up an article of clothing, such as shorts or pants, to a user's body which encircles less than 50% of the user's waist or the article of clothing waistband or waistline.

It is a further objective of the invention to provide a device for securing or holding up an article of clothing, such as shorts or pants, to a user's body in which the elastic clothing band has a length or stretchability that is less than halfway around the waist of a wearer or the shorts or pants waist band or waist line.

It is yet another objective of the invention to provide a device for securing or holding up an article of clothing, such as shorts or pants, to a user's body in which the elastic clothing band is configured to conform to the wearer's body as the body moves and/or the wearer sits down, thus preventing any associated pain, discomfort, or pressure to the body.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
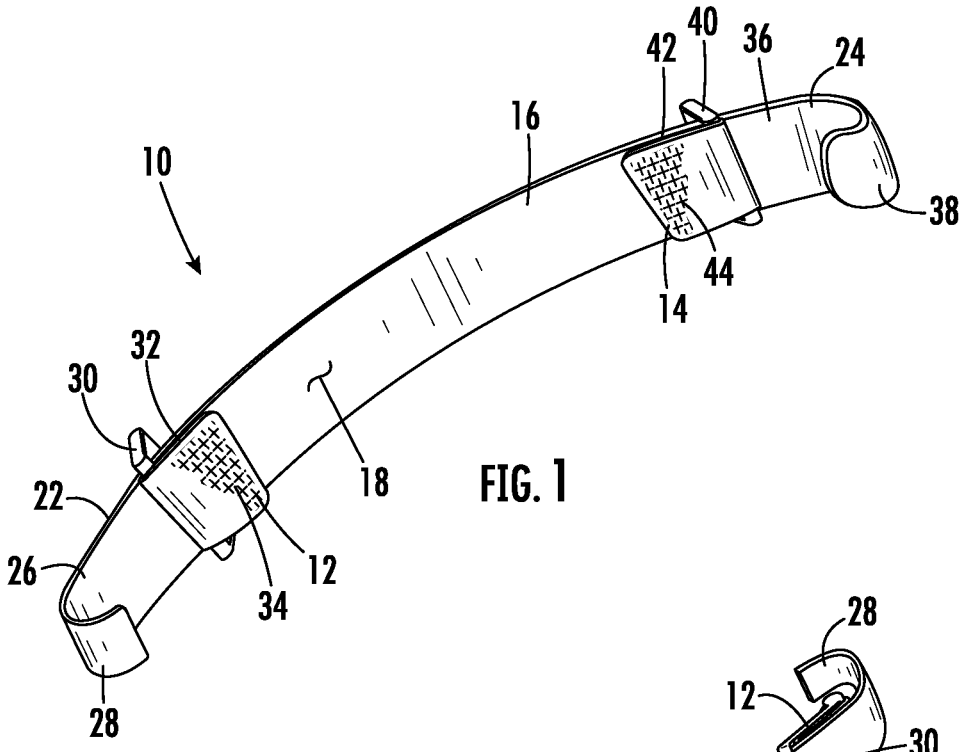
FIG. 1 is a perspective view of an illustrative embodiment of an elastic band for use with articles of clothing.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
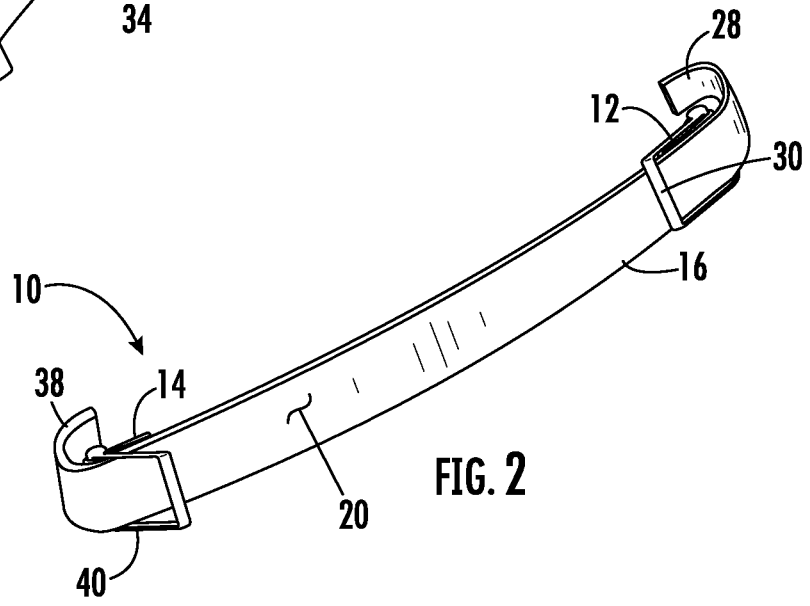
FIG. 2 is an alternative perspective view of the elastic band for use with articles of clothing shown in FIG. 1.

Referring to FIGS. 1-2, an illustrative embodiment of an elastic band for use with articles of clothing, referred to generally as elastic clothing band 10, is illustrated. The elastic clothing band 10 is configured to attach or secure to two different portions of an article of clothing, such as shorts or pants, and provide a mechanism for holding up the article of clothing to a user's body. The elastic band 10, an any other similar elastic band described herein, is made of an elastic material that allows it to stretch, expand, and return to its original, relaxed shape. Preferably, the elastic clothing band 10 material allows for at least a portion or the entire unit to traverse or moving from a first resting or relaxed position, to a second, stretched position when a force is applied (i.e. a hand pulling on it or being hooked to a belt loop), and return or move back to the original, relaxed positon when the force is removed. The elastic clothing band 10 may comprise a first end 12, a second opposing end 14, and a main body 16 separating the first end 12 and the second end 14. The elastic clothing band 10 may comprise a first inner surface 18 which faces the article of clothing when the elastic clothing band 10 is secured thereto, and a second outer surface 20 which faces away from the article of clothing when the elastic clothing band 10 is secured thereto.

A first securing member 22 is secured to or is integrally formed from the first end 12, and is configured to secure or attach to at least one first portion of the article of clothing. A second securing member 24 is secured to or is integrally formed from the second end 14 and is configured to secure or attach to at least one second portion of the article of clothing. The second portion of the article of clothing is different than the first portion of the article of clothing. The first securing member 22 may comprise an elongated body 26 which terminates in a clothing portion engaging member, illustrated herein as a curve shaped hook 28. The first securing member 22 may comprise a ring 30 which allows the first securing member 22 to be secured to the main body 16. In this manner, the first end 12 may be looped over a portion of the ring 30 and secured in place by fastening a portion of the first end 12 to a portion of the main body 16, thus forming a loop 32. As shown in FIG. 1, the first end 12 is secured to the main body 16 via a closure member, illustrated herein as stitching 34. Other closure members may include, for example, staples or chemical means, such as glue.

The second securing member 24 may comprise an elongated body 36 which terminates in a clothing portion engaging member, illustrated herein as a curve shaped hook 38. The second securing member 24 may comprise a ring 40 which allows for the second securing member 24 to be secured to the main body 16. In this manner, the second end 14 may be looped over a portion of the ring 40 and secured in place by fastening a portion of the second end 14 to a portion of the main body 16, thus forming a loop 42. As shown in FIG. 1, the second end 14 is secured to the main body 16 via a closure member, illustrated herein as stitching 44. Other closure members may include for example, staples or chemical means, such as glue.

Figure 3:
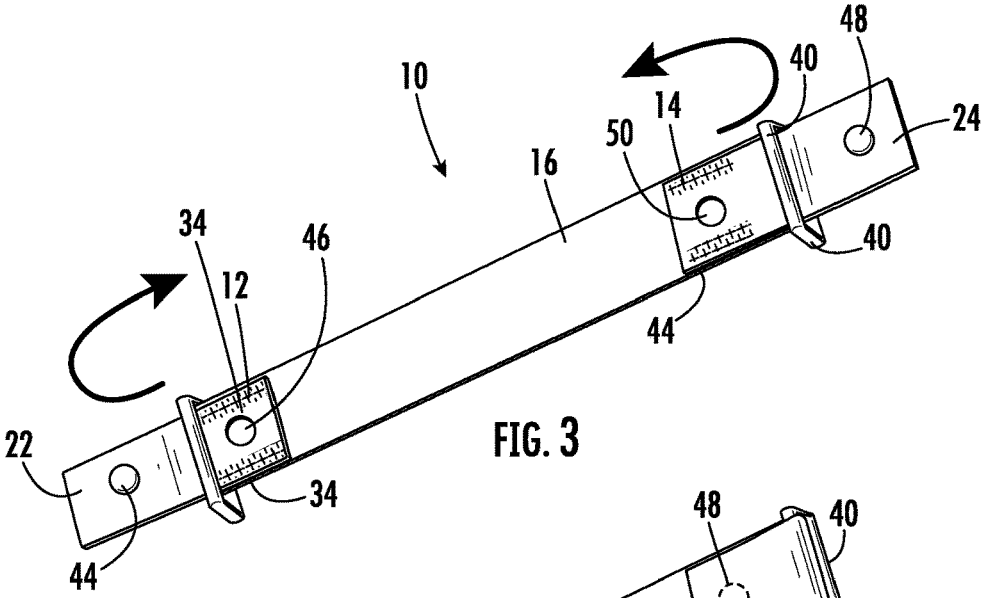
FIG. 3 is a perspective view of the elastic band for use with articles of clothing, shown with snap button fastening members.
Figure 4:
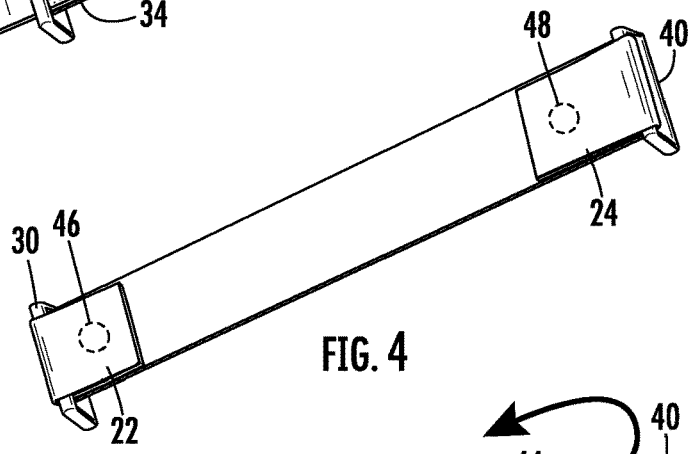
FIG. 4 illustrates the elastic band for use with articles of clothing shown in FIG. 3, with the snap buttons engaged.

While the preferred embodiment includes the use of curved shaped hooks 28 and 38 to secure or attach to portions of the user's clothing, other securing members may be used. FIGS. 3-8 illustrate embodiments of the elastic clothing band 10 having different types of clothing securing members. Each of the embodiments shown may have the same structures as described above, differing only in the clothing securing members. FIGS. 3 and 4 illustrate an embodiment of the elastic clothing band 10 using snap fasteners. As illustrated, the first securing member comprises a first snap fastener interlocking disc 44 that snaps to secure to a second snap fastener interlocking disc 46 positioned on the main body 16. The second securing member 24 comprises a third snap fastener interlocking disc 48 that snaps to secure to a fourth snap fastener interlocking disc 50 positioned on the main body 16. Securing the first snap fastener interlocking disc 44 to the second snap fastener interlocking disc 46 with a portion of the user's article of clothing (i.e. a belt loop) placed in between, and the third snap fastener interlocking disc 48 to the fourth snap fastener interlocking disc 50 with a different portion of the user's article of clothing (i.e. a belt loop) placed in between allows the elastic clothing band 10 to secure to the user's article of clothing.

Figure 5:
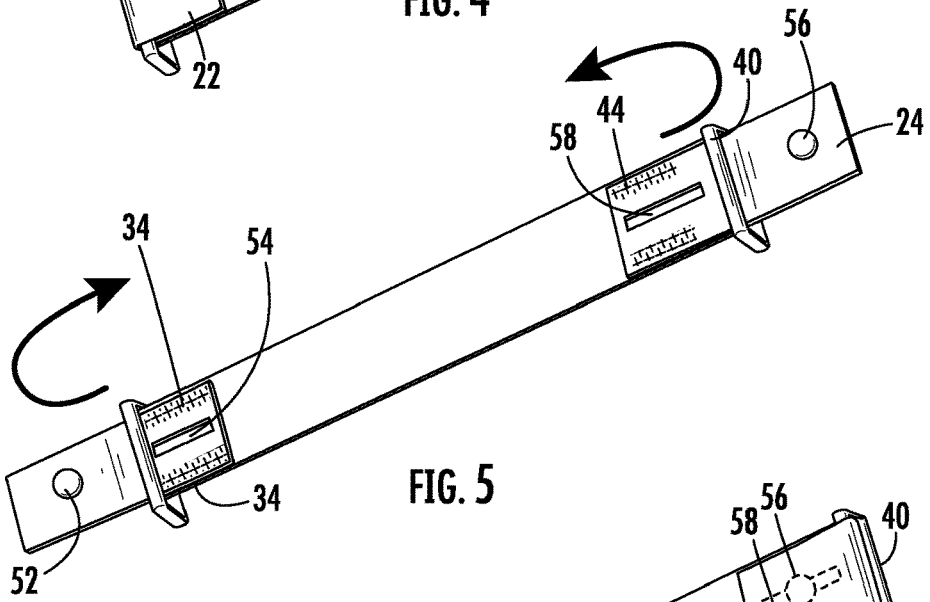
FIG. 5 is a perspective view of the elastic band for use with articles of clothing, shown with button fastening members.
Figure 6:
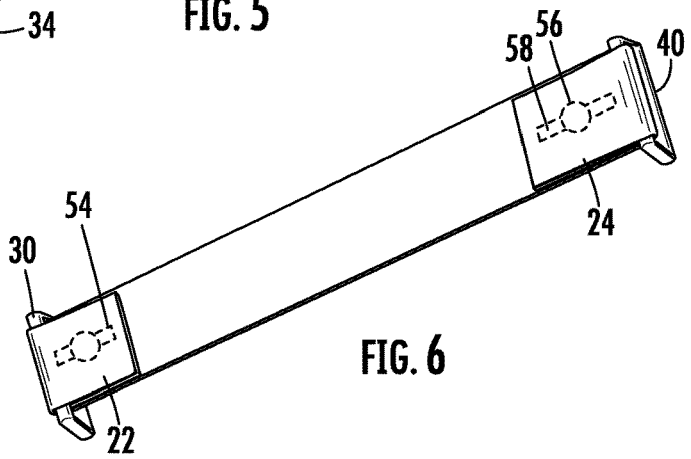
FIG. 6 illustrates the elastic band for use with articles of clothing shown in FIG. 5, with the buttons engaged.

FIGS. 5 and 6 illustrate an embodiment of the elastic clothing band 10 using buttons. As illustrated, the first securing member 22 comprises a first button 52 that secures to a first button receiving member, illustrated herein as slot 54 positioned on the main body 16. The second securing member 24 comprises a second button 56 that secures to a second button receiving member, illustrated herein as slot 58 positioned on the main body 16. Securing the first button 52 to the first button receiving slot 54 with a portion of the user's article of clothing (i.e. a belt loop) placed in between, and the second button 56 to the second button receiving slot 58 with a different portion of the user's article of clothing (i.e. a belt loop) placed in between allows the elastic clothing band 10 to secure to the user's article of clothing.

Figure 7:
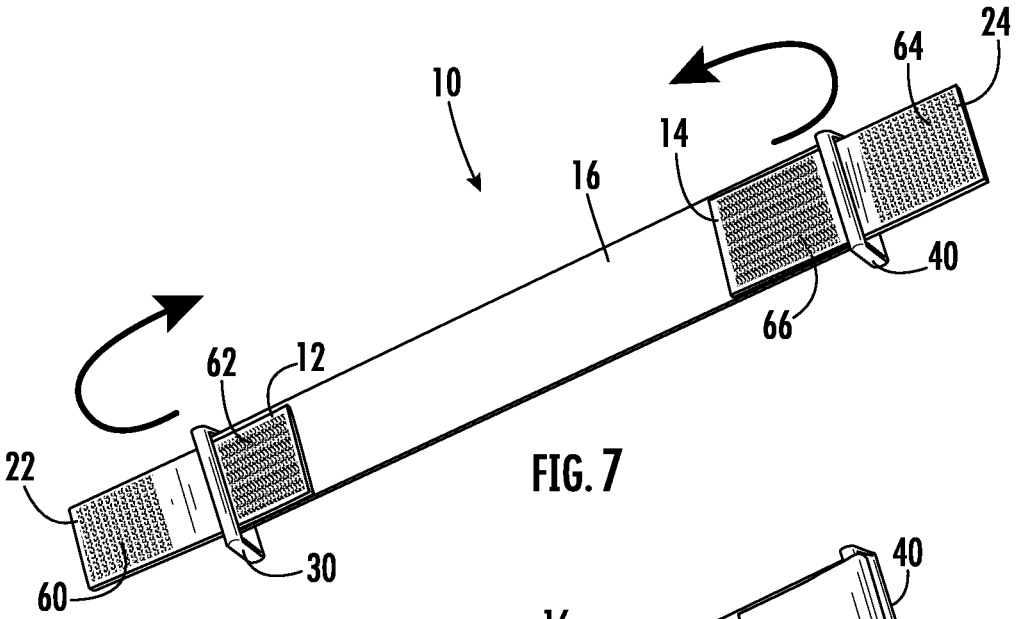
FIG. 7 is a perspective view of the elastic band for use with articles of clothing, shown with hook and loop fastening members.
Figure 8:
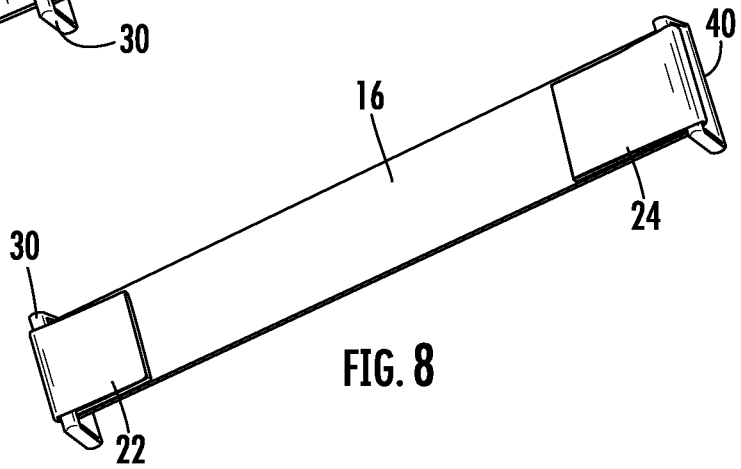
FIG. 8 illustrates the elastic band for use with articles of clothing shown in FIG. 7, with the hook and loop fastening members engaged.

FIGS. 7 and 8 illustrate an embodiment of the elastic clothing band 10 using loop and hook fastening members, such as VELCRO. As illustrated, the first securing member 22 comprises a first member of the first hook and loop fastener, hook fastener 60, which secures to a second member of the first hook and loop fastener, loop fastener 62, positioned on the first end 12 or on the main body 16 of the elastic clothing band 10. The second securing member comprises a first member of the second hook and loop fastener, hook fastener 64, which secures to a second member of the second hook and loop fastener, loop fastener 66, positioned on the second end 14 or on the main body 16 of the elastic clothing band 10. Securing the first member of the first hook and loop fastener, hook fastener 60, to the second member of the first hook and loop fastener, loop fastener 62, with a portion of the user's article of clothing (i.e. a belt loop) placed in between, and securing the second member of the second hook and loop fastener, hook fastener 64, to the second member of the second hook and loop fastener, loop fastener 66, with a different portion of the user's article of clothing (i.e. a belt loop) placed in between allows the elastic clothing band 10 to secure to the user's article of clothing.

Figure 10:
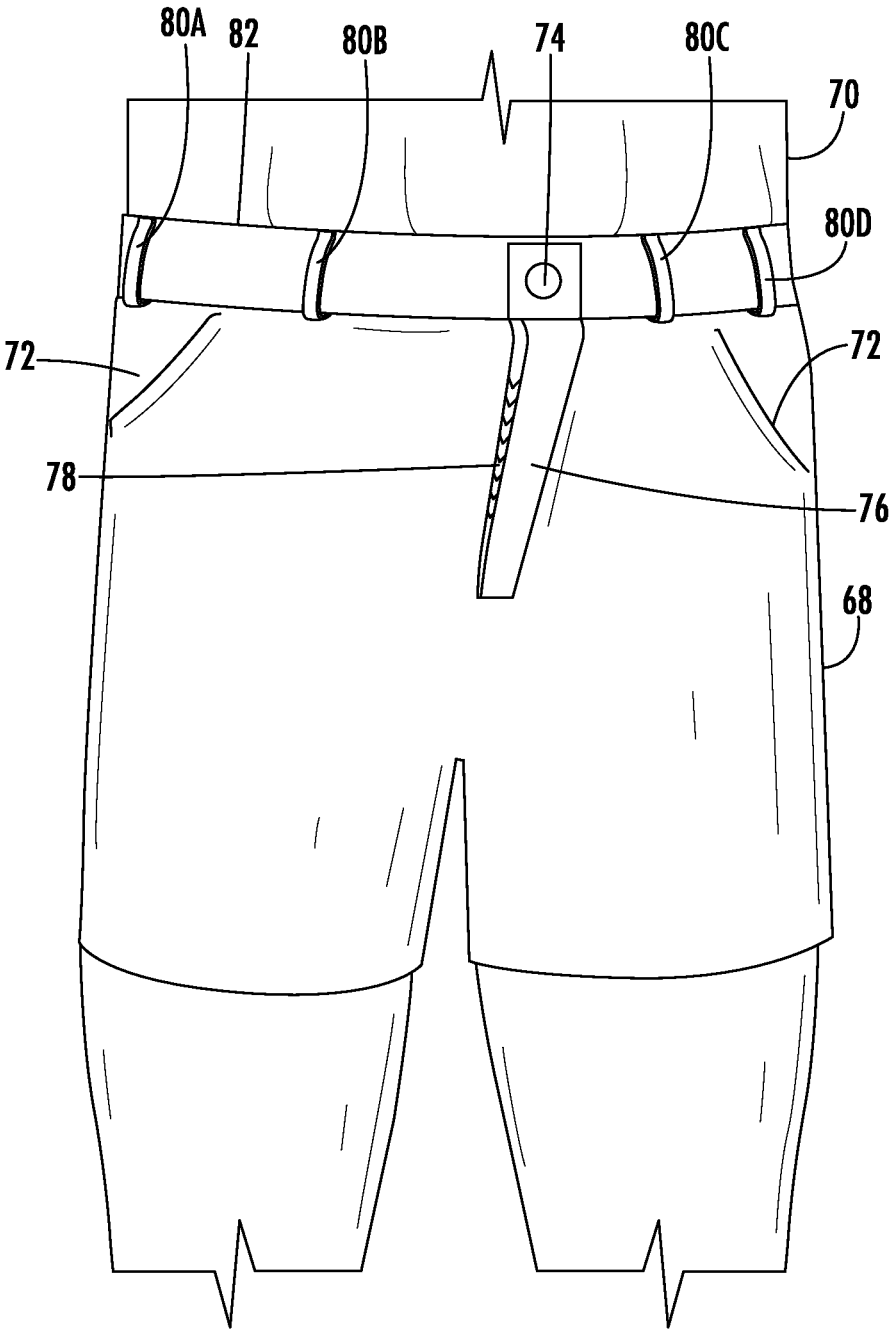
FIG. 10 illustrates a standard pair of pants.
Figure 11:
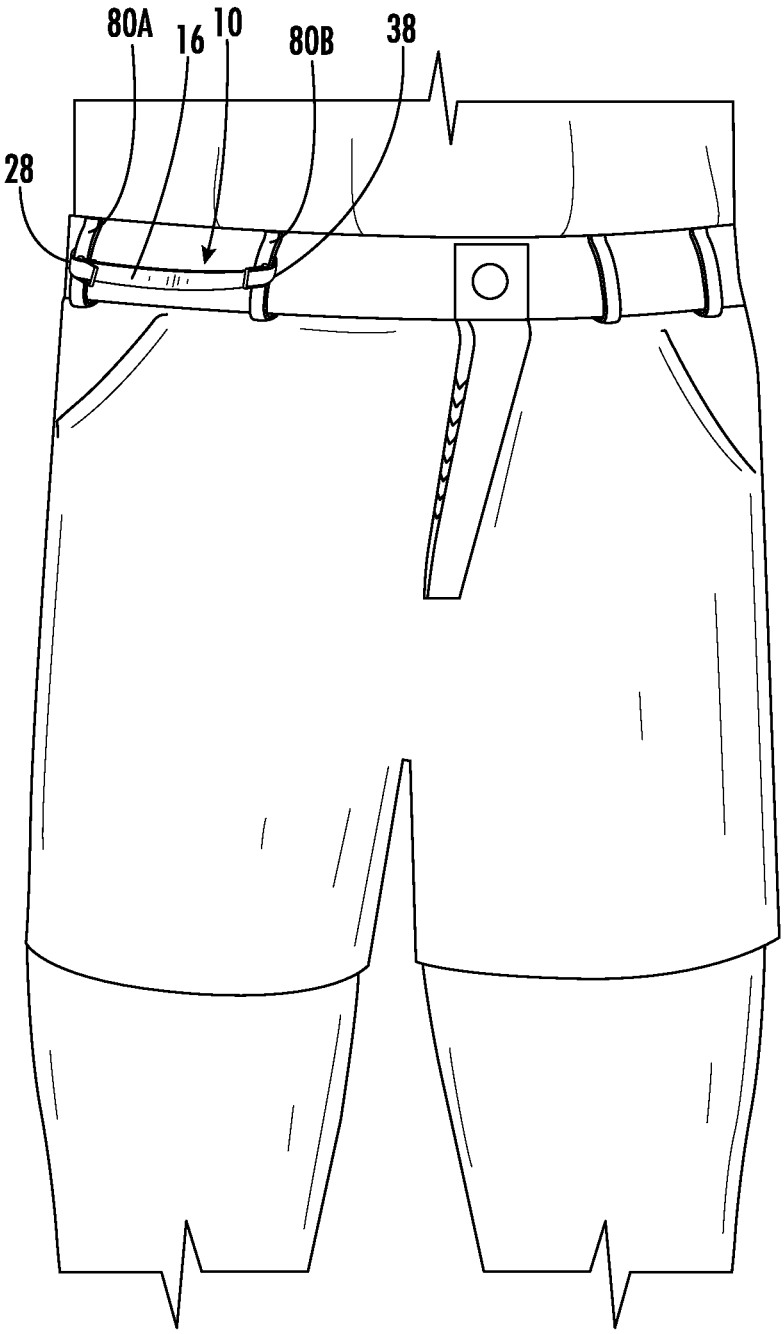
FIG. 11 illustrates the elastic band being secured to two belt loops.
Figure 12:
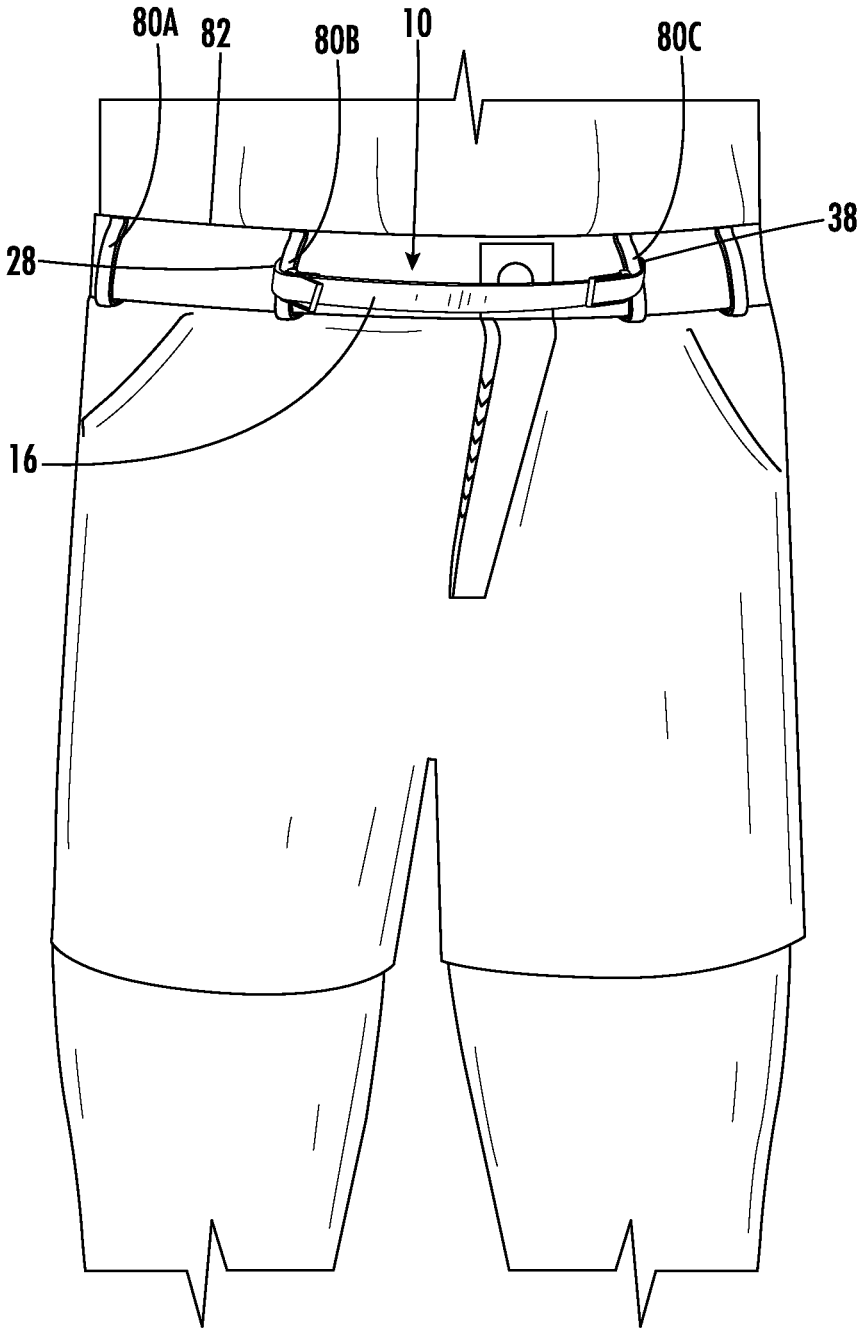
FIG. 12 illustrates the elastic band being secured to two different belt loops than shown in FIG. 11.
Figure 13:
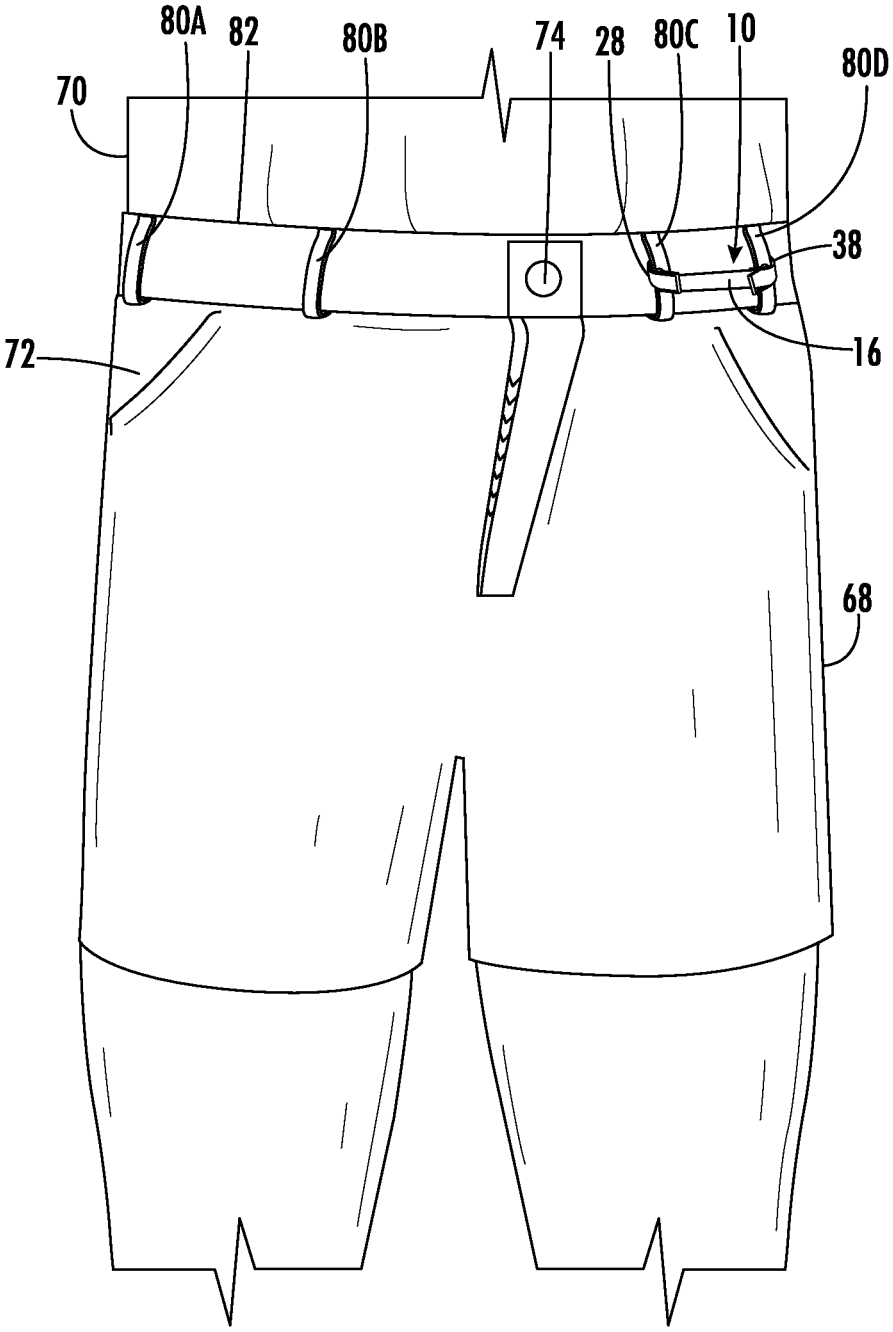
FIG. 13 illustrates the elastic band being secured to two different belt loops than shown in FIG. 11 or FIG. 12.
Figure 14:
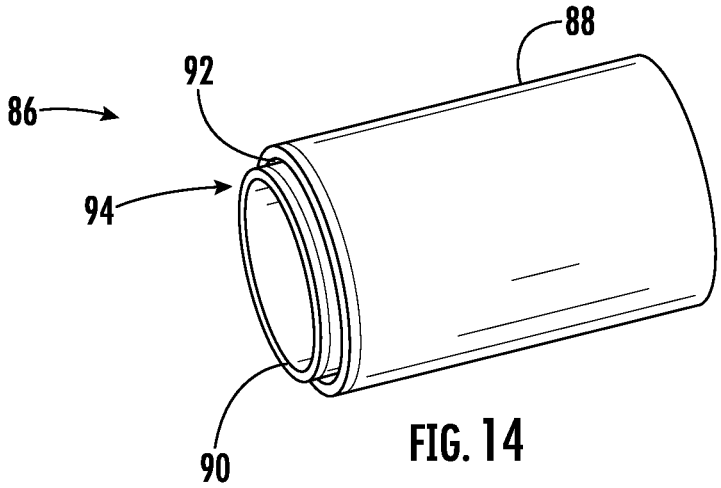
FIG. 14 illustrates an embodiment of an outer elastic band cover, shown in the non-extended position.
Figure 15:
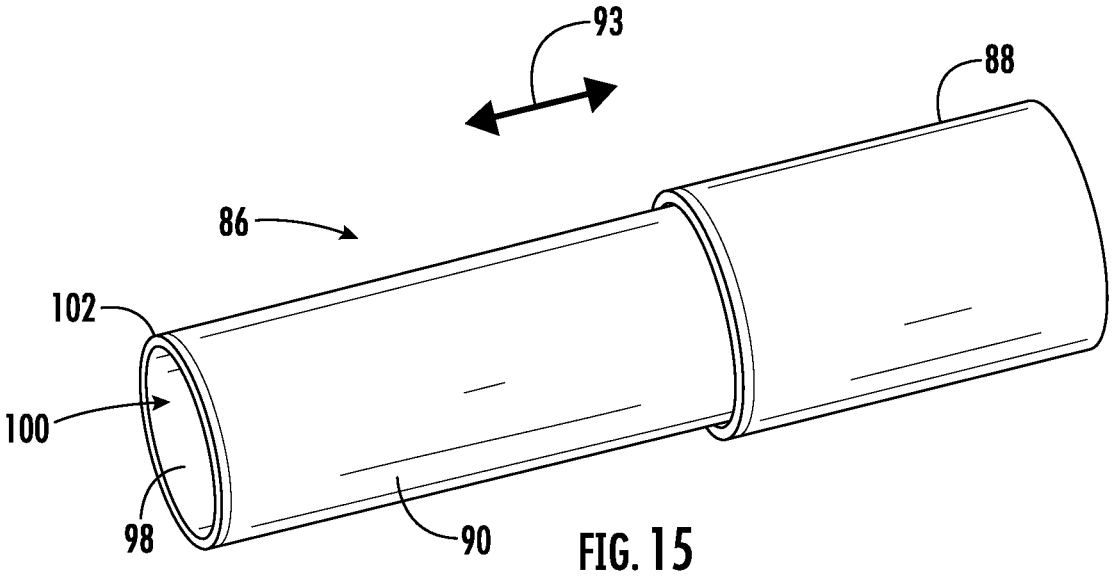
FIG. 15 illustrates the outer elastic band cover, shown in the extended position.
Figure 16:
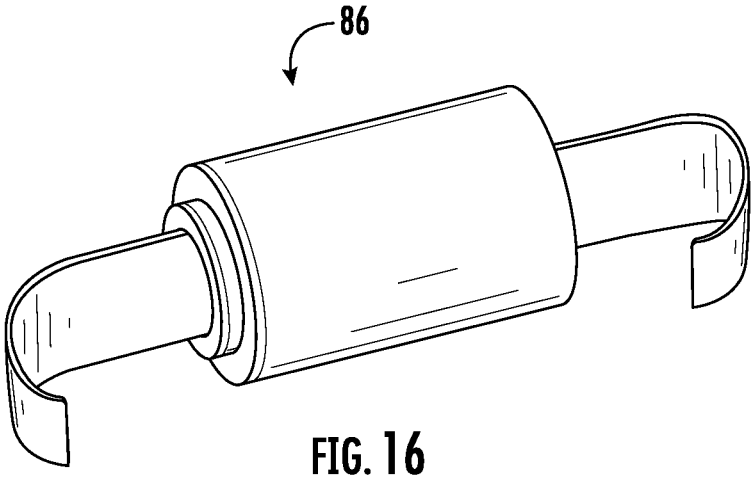
FIG. 16 illustrates the outer elastic band cover, shown in the non-extended position and with the first and second securing members.
Figure 17:
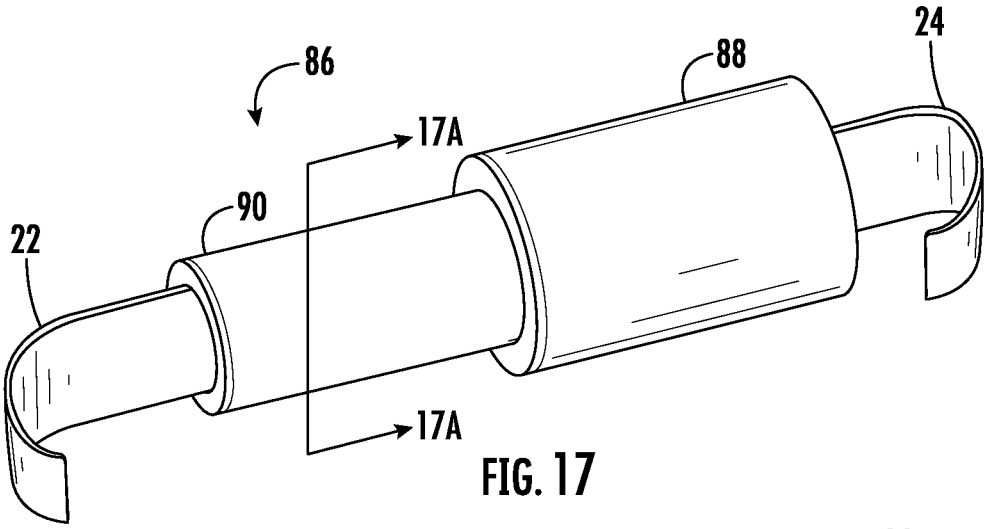
FIG. 17 illustrates the outer elastic band cover, shown in the extended position and with the first and second securing members.

Referring to FIG. 10, a typical pair of shorts 68 placed on a user's body 70 is shown. The shorts 68 may have pockets 72, a snap button 74, a panel 76 covering zipper tracks 78, and a plurality of belt loops, referred to generally as 80, but individually as 80A, 80B, 80C, and 80D positioned along the shorts waistline or waistband 82. In use, the elastic clothing band 10 is configured to secure or attach to two different portions of shorts 68. Preferably, the elastic clothing band 10 is designed to secure or attach to two different belt loops 80. In FIG. 11, the elastic clothing band 10 is secured to and stretched between belt loop 80A and belt loop 80B. In this arrangement, the first securing member curve shaped hook 28 hooks on to the belt loop 80A, thereby securing or attaching thereto. The second securing member curve shaped hook 38 secures or attaches to the belt loop 80B, by hooking thereto. FIG. 12 illustrates the elastic clothing band 10 being secured to and stretched between belt loop 80B and belt loop 80C. In FIG. 13, the elastic clothing band 10 is shown secured to and stretched between belt loop 80C and belt loop 80D.

Preferably, in the case of articles of clothing that are applied to a user's waist, such as shorts or pants, the elastic clothing band 10 is designed to work when secured to two portions of the article of clothing so the elastic clothing band 10 encircles less than 50% of the user's waist or the article of clothing waistband or waistline. Accordingly, the elastic clothing band 10 has a length or stretchability that is less than halfway around the waist of a wearer or the shorts or pants waist band or waist line.

The elastic clothing band 10 is preferably made of an elastic material, such that the material is capable of stretching, and more importantly, capable of stretching so as to return to its normal shape or size when a force that causes the stretching is released. The elastic material nature of the elastic clothing band 10 allows the elastic clothing band 10 to function as a device that holds up a person's shorts or pants without the need of wearing a belt or a pair of suspenders. The ability to stretch and return to its original shape allows the elastic clothing band 10 to cinch up the shorts or pants waistline. In use, the user applies the first securing member 22, such as the curve shaped hook 28 portion, to a first belt loop 80. Once secured thereto, the user stretches the main body 16 so the second securing member 24, via the curve shaped hook 38 portion, hooks to a second belt loop 80.

Once hooked, the main body 16 may contract back towards its original shape and/or size. The contraction of the main body 16 causes cinching of the waistband of the article of clothing. The elastic nature of the elastic clothing band 10 also allows the band to conform to the wearer's body as the body moves and/or the wearer sits down, thus preventing any associated pain, discomfort, or pressure to the body.

Figure 9:
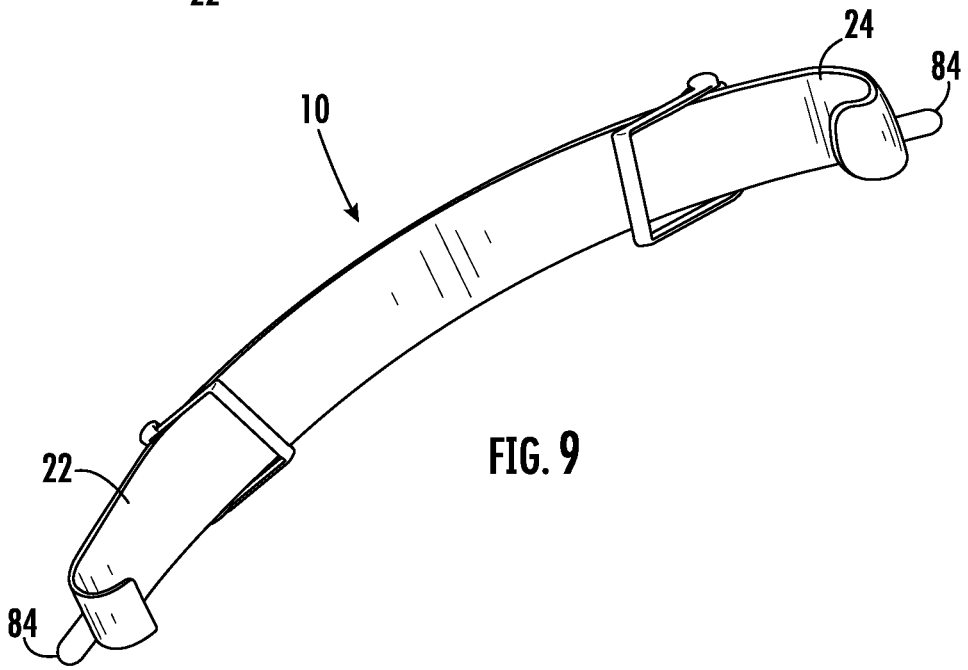
FIG. 9 illustrates an embodiment of the elastic band shown in FIG. 1 with a tab.

To aid the user in applying or removing the first securing member 22 or the second securing member 24, one or more portions of one or both may have a tab or appendage 84, see FIG. 9. The tab or appendage 84 may be attached to or molded on. The tab or appendage 84 may be made of a fixed rigid, flexible, or semi-flexible material. Alternatively, the tab or appendage 84 may be made of a movable rigid, flexible, or semi-flexible material so the user can push it out from or into the first securing member 22 or the second securing member 24.

Figure 18:
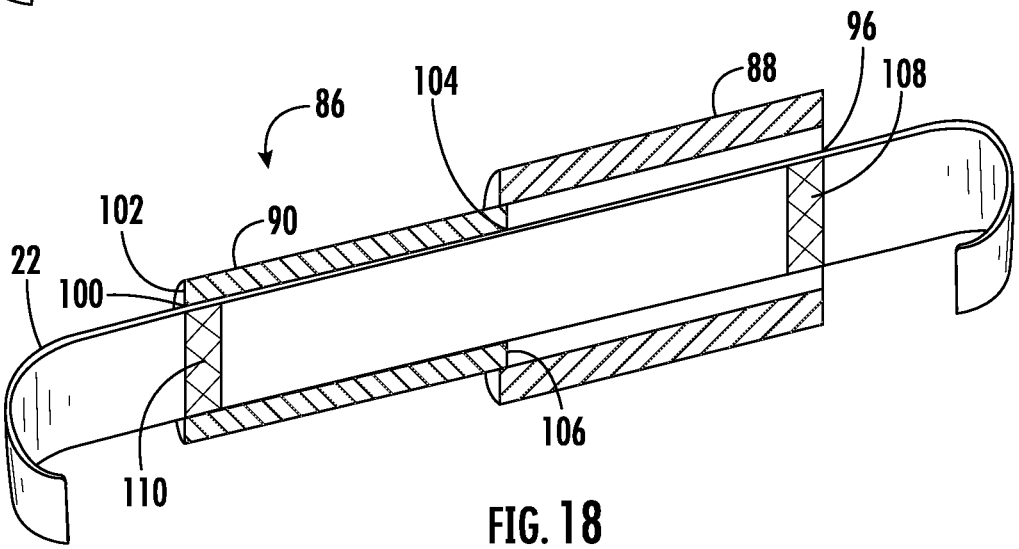
FIG. 18 is a cross sectional view taken along lines 17A-17A of FIG. 17.

The elastic clothing band 10 may include a sleeve or cover 86, see FIGS. 14-18. Preferably, the sleeve 86 is a two-piece flexible unit having an outer member 88 and an inner member 90. The outer member 88 has an internal lumen 92 sized and shaped to allow the inner member 90 to slide in a linear direction, in and out, see arrow 93, FIG. 15, through opening 94. The outer member 88 may have a second opening 96 at the opposite end. The inner member 90 may also include an inner lumen 98 and opening 100 at a first end 102. The inner member 90 may also include a second opening 104 at a second end 106, opposite the first opening 100. As illustrated in FIG. 18, the elastic clothing band 10 is placed inside the sleeve 86 and secured to the outer member 88 via securing members, such as stitching 108, and to the inner member 90 via securing members, such as stitching 110. Other securing members, such as staples or chemical fasteners, i.e. glue, may be used as well.

Figure 19:
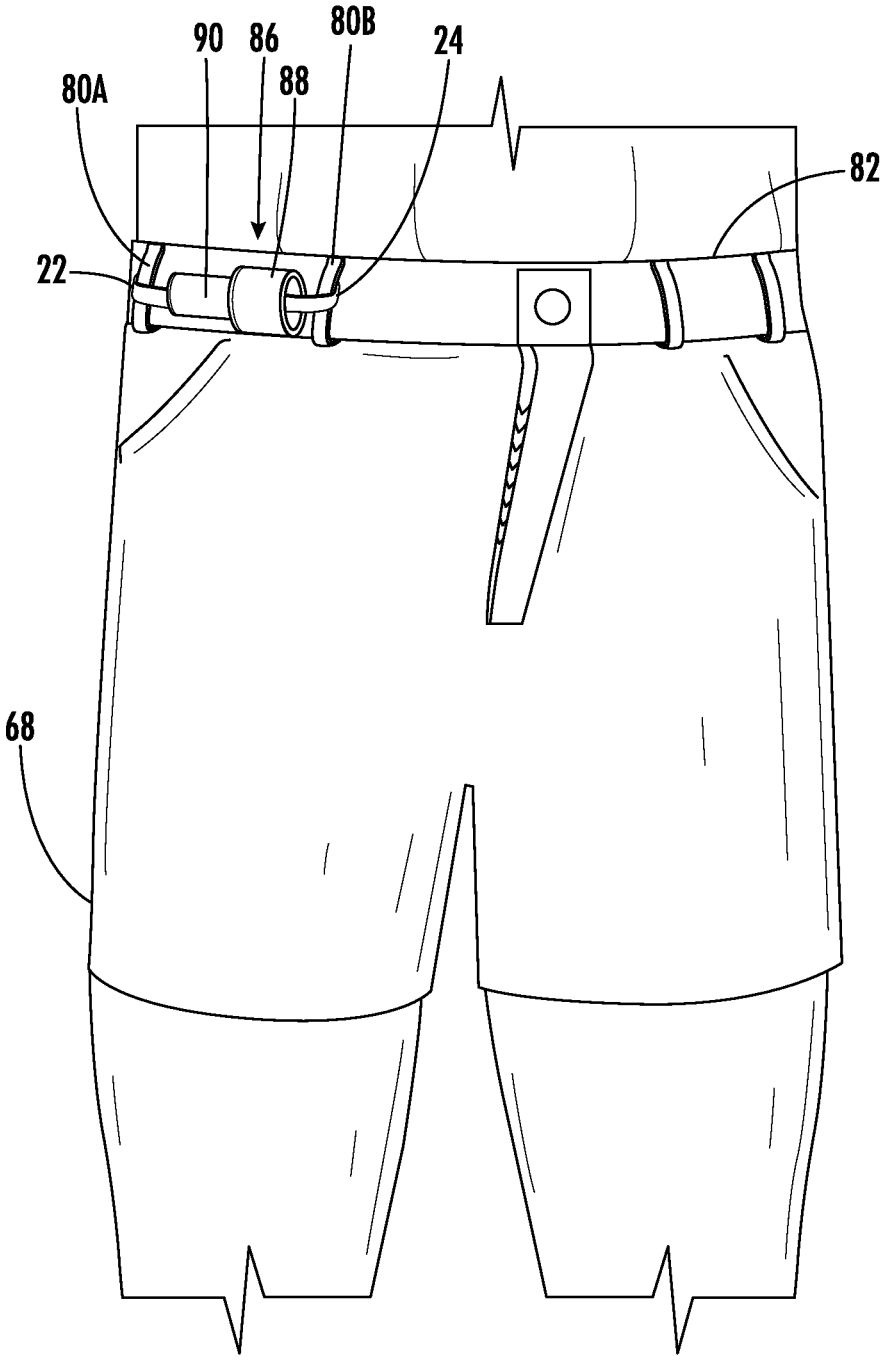
FIG. 19 illustrates the elastic band sleeve secured to two different belt loops.

The elastic clothing band 10 is preferably secured to the sleeve 86 so that the elastic clothing band first securing member 22 extends out of or out from the sleeve inner member 90, and the elastic clothing band second securing member 24 extends out of or out from the sleeve outer member 88. This allows the user the ability to hook the elastic clothing band second securing member 24 to belt loop 80B, see FIG. 19, and extend the sleeve inner member 90 out, away from the belt loop 80B and towards belt loop 80A. Once in position, the user can secure the elastic clothing band first securing member 22 to the belt loop 80A. The contraction of the elastic clothing band 10 allows the cinching of the pants waistband 82.

Figure 20:
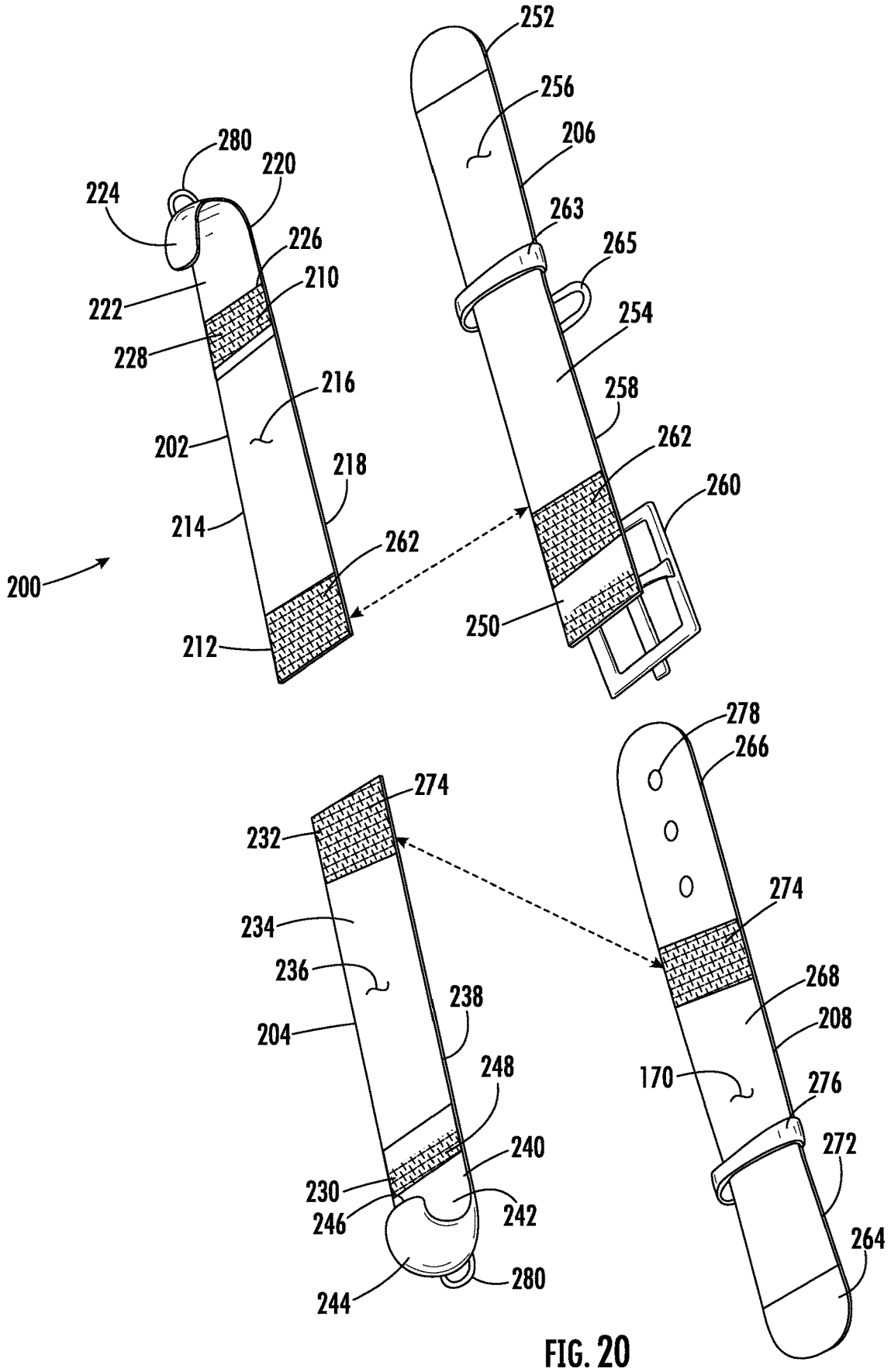
FIG. 20 is an alternative embodiment of the elastic band for use with articles of clothing.

Referring to FIG. 20, an alternative embodiment of the elastic band for use with articles of clothing, referred to generally as elastic clothing band 200, is shown. The elastic clothing band 200 functions in a similar manner as described for the elastic clothing band 10, using an elastic member to secure or attach to two different portions of an article of clothing, i.e. shorts or pants, as a mechanism to hold up a user's article of clothing, i.e. shorts or pants, without the need to wear a traditional belt that loops around the user's waistline. The elastic clothing band 200 uses the contraction of the elastic band to cinch the article of clothing, i.e. cinch the shorts' waistband or the pants' waistband. The elastic nature of the elastic clothing band 200 also allows the band to conform to the wearer's body as the body moves and/or sits down, thus preventing any associated pain, discomfort, or pressure to the body.

The elastic clothing band 200 may comprise a first inner elastic member 202, a separate, independent second inner elastic member 204, a first outer member 206 which is secured to the first inner elastic member 202, and a second outer member 208 which is secured to the second inner elastic member 204. The first inner elastic member 202 may comprise a first end 210, a second opposing end 212, and a main body 214 separating the first end 210 and the second end 212. The first inner elastic member 202 may comprise a first inner surface 216 which faces the article of clothing when the first inner elastic member 202 is secured thereto. A second outer surface 218 faces and secures to or rests on the first outer member 206.

A first securing member 220 is secured to or is integrally formed from the first end 210 of the first inner elastic member 202, and is configured to secure or attach to at least one first portion of the article of clothing. The first securing member 220 comprises an elongated body 222 which terminates in a clothing portion engaging member, illustrated herein as a curve shaped hook 224. The first securing member 220 may comprise a ring 226 which allows the first securing member 220 to be secured to the main body 214. In this manner, the first end 210 may be looped over a portion of the ring 226 and secured in place by fastening a portion of the first end 110 to a portion of the main body 214, thus forming a loop. The first end 210 is secured to the main body 214 via closure member, illustrated herein as stitching 228. Other closure members may include, for example, staples or chemical means, such as glue.

The second inner elastic member 204 may comprise a first end 230, a second opposing end 232, and a main body 234 separating the first end 230 and the second end 232. The second inner elastic member 204 may comprise a first inner surface 236 which faces the article of clothing when the second inner elastic member 204 is secured thereto. A second outer surface 238 faces and secures to or rests on the second outer member 208.

A second securing member 240 is secured to or is integrally formed from the first end 230 of the second inner elastic member 204, and is configured to secure or attach to at least a second portion of the article of clothing. The second securing member 240 comprises an elongated body 242 which terminates in a clothing portion engaging member, illustrated herein as a curve shaped hook 244. The second securing member 240 may comprise a ring 246 which allows the second securing member 240 to be secured to the main body 234. In this manner, the first end 230 may be looped over a portion of the ring 246 and secured in place by fastening a portion of the first end 230 to a portion of the main body 234, thus forming a loop. The first end 230 is secured to the main body 234 via closure member, illustrated herein as stitching 248. Other closure members may include, for example, staples or chemical means, such as glue.

While the preferred embodiment includes the use of curved shaped hooks 224 and 244 to secure or attach to portions of the user's clothing, other securing members may be used, such as those described in FIGS. 3-8.

Preferably, in the case of articles of clothing that are applied to a user's waist, such as shorts or pants, the elastic clothing band 200 is designed to work when secured to two portions of the article of clothing so the elastic clothing band 100 encircles less than 50% of the user's waist or article of clothing waistband or waistline. Accordingly, the elastic clothing band 200 has a length or stretchability that is less than halfway around the waist of a wearer or of the shorts or pants waistband/waistline. As such, the first inner elastic member 202 and the separate, independent second inner elastic member 204 are preferably made of an elastic material such that the material is capable of stretching, and more importantly, capable of stretching so as to return to its normal shape or size when a force that causes the stretching is released. The elastic material nature of the first inner elastic member 202 and the separate, independent second inner elastic member 204 allows the elastic clothing band 200 to function as a device that holds up a person's shorts or pants without the need of wearing a belt or a pair of suspenders. The ability to stretch and return to its original shape allows the elastic clothing band 200 to cinch up the shorts' or pants' waistline. The elastic nature of the elastic clothing band 200 also allows the band to conform to the wearer's body as the body moves and/or sits down, thus preventing any associated pain, discomfort, or pressure to the body.

The first outer member 206 may comprise a first end 250, a second opposing end 252, and a main body 254 separating the first end 250 and the second end 252. The first outer member 206 may comprise a first inner surface 256 which faces and secures, rests on, or abuts up against the first inner elastic member outer surface 218. A second outer surface 258 faces away from the user's waistline when secured to the article of clothing. The first outer member 206 is made of a non-elastic material, such as leather, artificial or synthetic leather, or plastic materials. Preferably, the first outer member 206 forms one-half of a traditional belt buckle, and may include, for example, a roller belt buckle 260, which secures or attaches to the first end 250. Other buckles known to one of skill in the art, such as a tongue buckle may be used. The roller belt buckle 260 provides adjustment on overall length.

The first inner elastic member second end 212 secures to the first outer member 206 via a closure member, illustrated herein as stitching 262. Other closure members may include, for example, staples or chemical means, such as glue. The first outer member 206 may include an inner loop 263 which receives the first elastic inner curve shaped hook 224 prior to the user wearing the elastic clothing band 200, thus drawing the first outer member 206 closer to the waistband at the outer ends, forming the curvature of the body. The first outer member 206 may include an outer loop 265 which receives at least a portion of the second outer member 208.

The second outer member 208 is made of a non-elastic material, such as leather, artificial or synthetic leather, or plastic materials. The second outer member 208 may comprise a first end 264, a second opposing end 266, and a main body 268 separating the first end 264 and the second end 266. The second outer member 208 may comprise a first inner surface 270 which faces and secures, rests on, or abuts up against the second inner elastic member outer surface 238. A second outer surface 272 faces away from the user's waistline when secured to the article of clothing.

The second inner elastic member secures or attaches to the second outer member 208 via a closure member, illustrated herein as stitching 274. Other closure members may include for example, staples or chemical means, such as glue. The second outer member 208 may include an inner loop 276 which receives the second elastic inner curve shaped hook 244 prior to the user wearing the elastic clothing band 200, thus drawing second outer member 208 closer to the waistband at the outer ends, forming the curvature of the body. The second outer member 208 may include a plurality of adjustment openings 278 at the second end 266. Each adjustment opening 278 is sized and shaped to engage with at least a portion of the belt buckle 260.

One or more portions of the first securing member curve shaped hook 224 and/or the second securing member curve shaped hook 244 may have a tab or appendage 280. The tab or appendage 280 may be attached to or molded on. The tab or appendage may be made of a fixed rigid, flexible, or semi-flexible material. Alternatively, the tab or appendage 180 may be made of a movable rigid, flexible, or semi-flexible material so the user can push it out from or into the first securing member 220, preferably the first elastic inner curve shaped hook 224, or the second securing member 240, preferably the second elastic inner curve shaped hook 244.

Similar to the elastic clothing band 10, the elastic clothing band 200 is configured to secure or attach to two different portions of the article of clothing, i.e. shorts or pants. Preferably, the elastic clothing band 200 is designed to secure or attach to two different belt loops, such as the belt loops 80 described in FIGS. 10-13. Accordingly, the elastic clothing band 200 may be secured to and stretched between two belt loops, such as 80A and 80B. In this arrangement, the first securing member curve shaped hook 224 hooks onto the belt loop 80A, thereby securing or attaching thereto. The second securing member curve shaped hook 244 secures or attaches to the belt loop 80B, by hooking thereto.

Preferably, in the case of articles of clothing that are applied to a user's waist, such as shorts or pants, the elastic clothing band 200 is designed to work when secured to two portions of the article of clothing so the elastic clothing band 100 encircles less than 50% of the user's waist or article of clothing waistband or waistline. Accordingly, the elastic clothing band 200 has a length or stretchability that is less than halfway around the waist of a wearer or the shorts or pants waistband or waistline.

The elastic nature of the elastic clothing band 200 allows the elastic clothing band 200 to function as a device that holds up a person's shorts or pants without the need of wearing a belt or a pair of suspenders. The ability to stretch and return to its original shape allows the elastic clothing band 200 to cinch up the shorts' or pants' waistline. In use, the user applies the first securing member 220, such as the curve shaped hook 224 portion to a first belt loop 80. Once secured thereto, the user stretches the main body 234 so the second securing member 240, via the curve shaped hook 244 portion, hooks to a second belt loop 80. The elastic nature of the elastic clothing band 200 also allows the band to conform to the wearer's body as the body moves and/or sits down, thus preventing any associated pain, discomfort, or pressure to the body. Once hooked, the first inner elastic member 202 and the second inner elastic member 204 may contract back towards its original shape and/or size. The contraction causes cinching of the waistband of the article of clothing.

Figure 21:
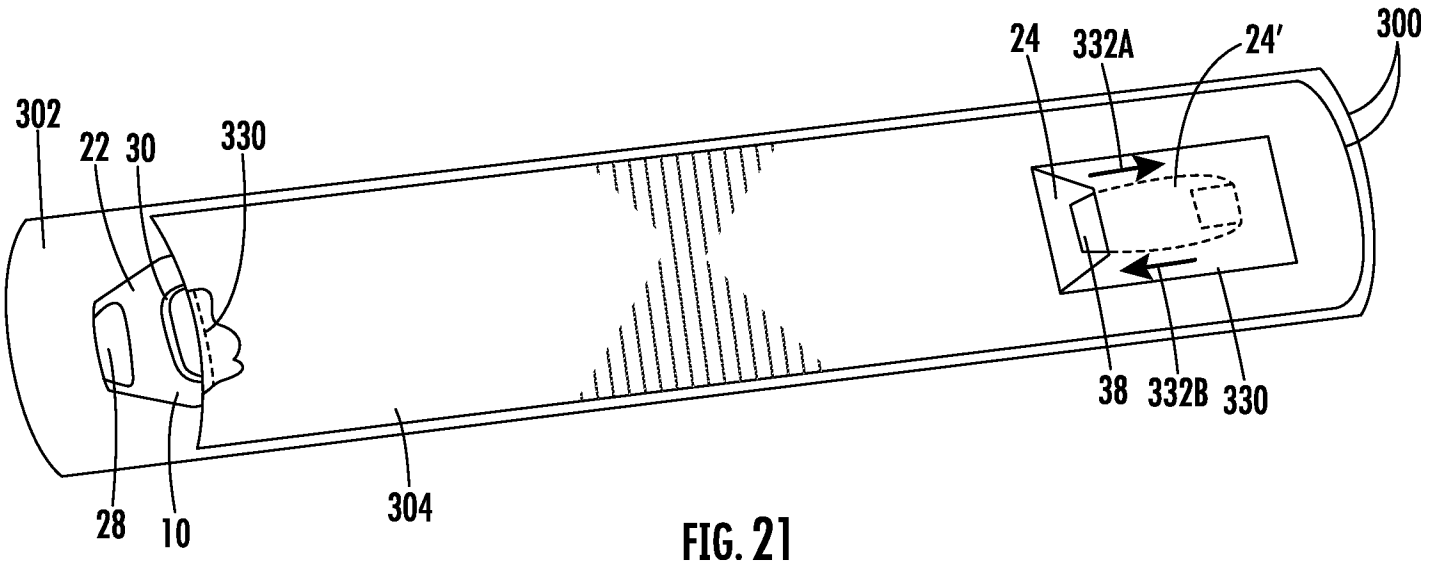
FIG. 21 illustrates an embodiment of the elastic band shown in FIG. 1 with a covering.
Figure 22:
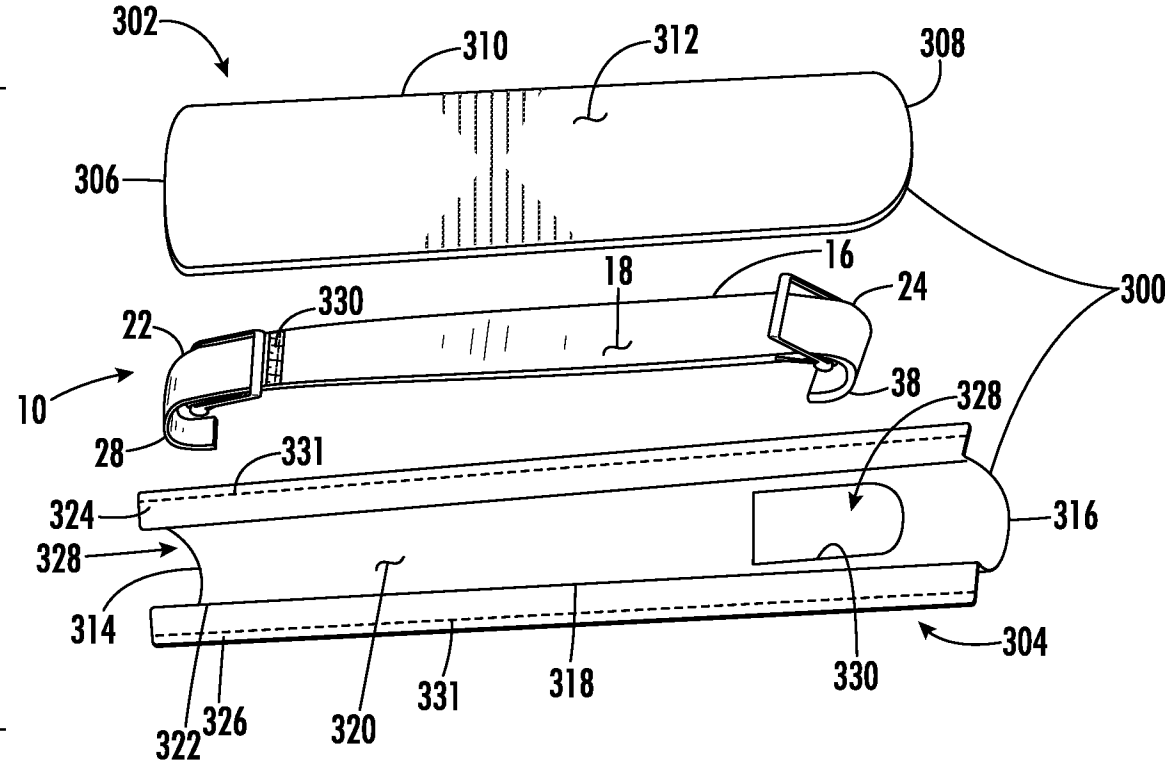
FIG. 22 is an exploded view of the elastic band with the covering illustrated in FIG. 21.

Referring to FIGS. 21-22, the elastic clothing band is shown with a covering 300. The hidden covering 300 includes a first or outer member 302, illustrated herein as a leather strap, and a second or inner member 304, illustrated herein as a flexible vinyl member. While the first or outer member 302 is described as a leather strap, it may be made of or from any other materials. The first or outer member 302 may have a first end 306, a second opposing end 308, and a main body 310. The main body 310 includes a first surface 312, and a second surface (not shown).

While the second or inner member 304 is described as a flexible vinyl member, it may be made from or of any other materials. The second or inner member 304 may have a first end 314, a second opposing end 316, and a main body 318. The main body 318 includes a first surface 320, and a second surface (not shown). The main body 318 may include a rounded wall 322, terminating in a first planar or flat wall 324 and a second planar or flat wall 326. The main body rounded wall 322 may be of sufficient size, shape, and height to provide an interior, which may also be defined as an internal pathway or passageway 328 to allow an object to rest and/or move within. The main body rounded wall 322 may also include a window 330. The window 330 may be a cut-out portion of the main body rounded wall 322, allowing visualization of or into the internal pathway or passageway 328.

In use, a securing member, illustrated herein as stitching 331, secures at least one portion of the elastic clothing band 10 to the surface 312 of the first or outer member 302. While described as stitching 331, other securing members such as chemical fasteners, i.e. glue, staples, buttons, zippers, may also be used. As illustrated, the at least one portion of the elastic clothing band 10 secured to the first or outer member 302 is a portion of the first securing member 22. In this arrangement, the first securing member 22 is relatively fixed in place while the second securing member 24 is free to traverse or move between one or more positions within the window 330, i.e. placed in a stretched-out position, see broken lined second securing member 24' in FIG. 21, as the elastic clothing band 10 is stretched (arrow 332A) or when the elastic clothing band 10 is in a relaxed position (arrow 332B), non-broken lined. Acting as a guide and a mechanism to maintain the free end of elastic clothing band 10 in place, the second or inner member 304 is secured to a different portion(s) of the surface 312 of the first or outer member 302. Preferably, the first planar or flat wall 324 and the second planar or flat wall 326 are secured to the surface 312 of the first or outer member 302 via stitching 331, in a position to allow the main body rounded wall 322 to be placed over and surround the elastic clothing band 10, with the second securing member 24, preferably the curved shaped hooks 38 to be resting within the window 330. Other securing members, such as chemical fasteners, i.e. glue, staples, buttons, zippers, may also be used. The second or inner member 304 may be sized to extend to both ends (314, 316) of the first or outer member 302, or to a distance that is less than at both ends (314, 316) of the first or outer member 302.

Figure 23:
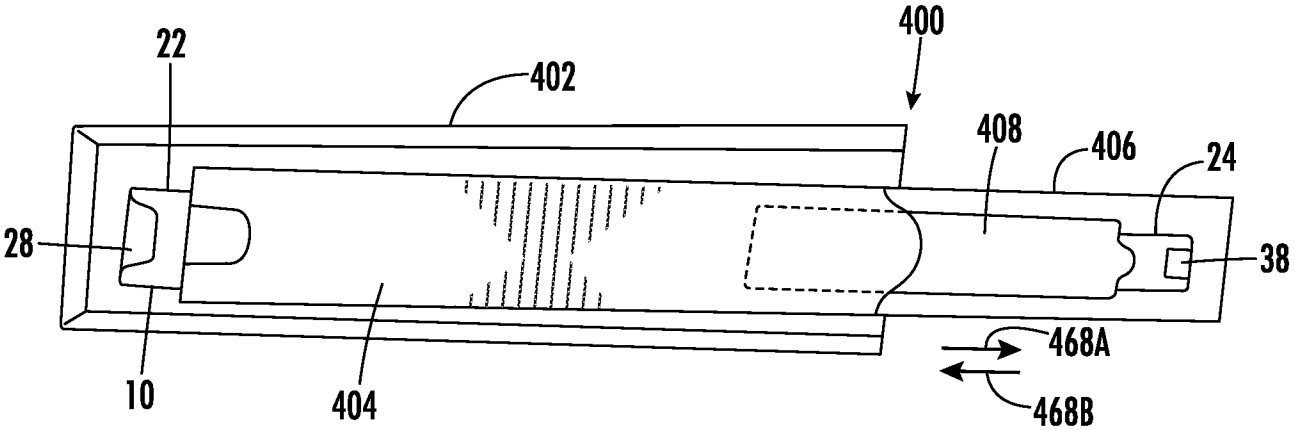
FIG. 23 illustrates an embodiment of the elastic band shown in FIG. 1 with an alternative covering embodiment.
Figure 24:
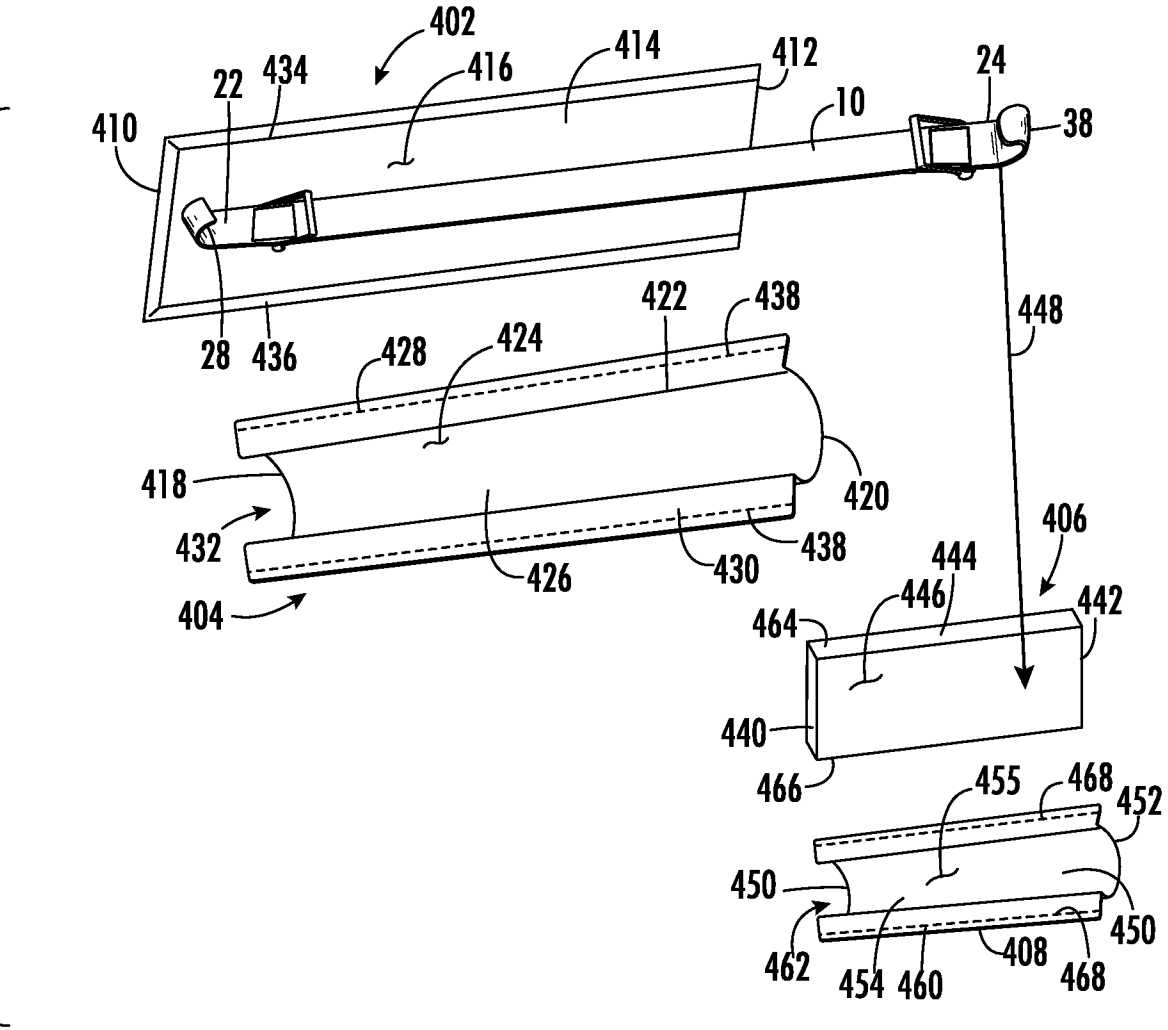
FIG. 24 is an exploded view of the elastic band with the covering illustrated in FIG. 23.

Referring to FIGS. 23-24, the elastic clothing band 10 is shown with an alternative covering 400. The covering 400 includes a first outer member 402, a first outer sleeve 404, a second inner member 406, and a second, inner sleeve 408. The first outer member 402 comprises a first end 410, a second opposing end 412, and a main body 414. The main body 414 includes a first surface 416, and second opposing surface (not shown). At least a portion of the elastic clothing band 10, i.e. at or near the hook portion 28, secures to the first surface 416 of the main body 414, preferably by stitching, or other securing members, such as chemical fasteners, i.e. glue, staples, buttons.

The first outer sleeve 404 may have a first end 418, a second opposing end 420, and a main body 422. The main body 422 includes a first surface 424, and a second surface (not shown). The main body 422 may include a rounded wall 426, having a first planar or flat wall 428 and a second planar or flat wall 430. The main body rounded wall 426 may be of sufficient size and height to provide an internal pathway or passageway 432 to allow an object to rest and/or move within. The first outer sleeve 404, which may be made of a flexible material, is secured to the first surface 424 of the first outer member 402 at two different positions, i.e. near or away from the top 434 and near or away from the bottom 436, via stitching 438, or other securing members, such as chemical fasteners, i.e. glue, staples, buttons. The size and shape of the internal pathway or passageway 432 should be sufficient to cover or surround at least portions of the elastic clothing band 10.

The second or inner member 406 comprises a first end 440, a second opposing end 442, and a main body 444. The main body 444 includes a first surface 446, and a second opposing surface (not shown). At least a portion of the elastic clothing band 10, i.e. at or near the hook portion 38, secures to the first surface 446 of the main body 444, see arrow 448, preferably by stitching, or other securing members, such as chemical fasteners, i.e. glue, staples, buttons.

The second or inner sleeve 408 may have a first end 450, a second opposing end 452, and a main body 454. The main body 454 includes a first surface 455, and a second surface (not shown). The main body 454 may include a rounded wall 456, having a first planar or flat wall 458 and a second planar or flat wall 460. The main body rounded wall 456 may be of sufficient size and height to provide an internal pathway or passageway 462 to allow an object to rest and/or move within. The second or inner sleeve 408, which may be made of a flexible material, is secured to the first surface 455 of the second outer member 406 at two different positions, i.e. near or away from the top 464 and near or away from the bottom 466, via stitching 468, or other securing members, such as chemical fasteners, i.e. glue, staples, buttons. The size and shape of the internal pathway or passageway 462 should be sufficient to cover or surround at least portions of the elastic clothing band 10, i.e. the second hook portion 38.

In use, the second or inner member 406, with the second hook portion 38 and second or inner sleeve 408, is configured to slide and move within the first outer sleeve 404 as the elastic clothing band 10, particularly the second securing member 24, is traversed or moved from a relaxed position to a stretched-out position, and back to the relaxed position, see arrows 468A and 468B. Accordingly, when the elastic clothing band 10 is stretched out, the second or inner member 406 extends out from the first or outer member 402. When the elastic clothing band 10 is in the relaxed position, the second or inner member 406 slides (and rests) within the first outer sleeve 404.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A band for use with articles of clothing comprising:

a first member configured to attach or secure to a first portion of an article of clothing, said first member comprising a first inner elastic member and a first outer member, said first outer member is made of a non-elastic material;

a second member configured to attach or secure to a second portion of an article of clothing, said second member comprising a second inner elastic member and a second outer member, said second outer member is made of a non-elastic material;

a fastening member configured to fasten said first member to said second member.

2. The band for use with articles of clothing according to claim 1, wherein, said first inner elastic member comprises a first end, a second opposing end, a main body separating said first end and said second end, and a first clothing portion engaging member configured to engage with said first portion of an article of clothing, and said second inner elastic member comprises a first end, a second opposing end, a main body separating said first end and said second end, and a second clothing portion engaging member configured to engage with said second portion of an article of clothing.

3. The band for use with articles of clothing according to claim 2, wherein, said first clothing portion engaging member comprises a hook, and said second clothing portion engaging member comprises a hook.

4. The band for use with articles of clothing according to claim 2, wherein, said first inner elastic member is made of an elastic material, wherein said main body traverses from a first relaxed position to a second, elongated position when stretched by application of a force, and said second inner elastic member is made of an elastic material, wherein said main body traverses from a first relaxed position to a second, elongated position when stretched by application of a force.

5. The band for use with articles of clothing according to claim 2, wherein, said first inner elastic member is made of an elastic material that stretches when a force is applied, and returns to a non-stretched position when said force is removed, said second inner elastic member is made of an elastic material that stretches when a force is applied, and returns to a non-stretched position when said force is removed.

6. The band for use with articles of clothing according to claim 2, wherein, said first inner elastic member second end is secured to said first outer member, wherein when a force is applied, said first end of said first inner elastic member stretches relative to said fixed second end of said first inner elastic member, and said second inner elastic member second end is secured to said second outer member, wherein when a force is applied, said first end of said second inner elastic member stretches relative to said fixed second end of said second inner elastic member.

7. The band for use with articles of clothing according to claim 6, wherein said first inner elastic member second end is secured to said first outer member via stitching, and said second inner elastic member second end is secured to said second outer member via stitching.

8. The band for use with articles of clothing according to claim 6, wherein said first inner elastic member second end is secured to said first outer member via a chemical composition, and said second inner elastic member second end is secured to said second outer member via a chemical composition.

9. The band for use with articles of clothing according to claim 6, wherein said first inner elastic member second end is secured to said first outer member via one or more staples, and said second inner elastic member second end is secured to said second outer member via one or more staples.

10. The band for use with articles of clothing according to claim 2, wherein said first clothing portion engaging member comprises a snap fastener, and said second clothing portion engaging member comprises a snap fastener.

11. The band for use with articles of clothing according to claim 2, wherein said first clothing portion engaging member comprises a button, and said second clothing portion engaging member comprises a button.

12. The band for use with articles of clothing according to claim 2, wherein said first clothing portion engaging member comprises loop or hook fastening members, and said second clothing portion engaging member comprises loop or hook fastening members.

13. The band for use with articles of clothing according to claim 1, wherein said first outer member or said second outer member is made of natural leather, synthetic leather, plastic material, or combinations thereof.

14. The band for use with articles of clothing according to claim 1, wherein said fastening member is an adjustable buckle.

15. The band for use with articles of clothing according to claim 1, wherein, said first member comprising a first covering material secured to said first outer member and covering at least a portion of said first inner elastic member, and said second member comprising a second covering material secured to said second outer member and covering at least a portion of said second inner elastic member.

* * * * *